US006565231B1

(12) United States Patent
Cok

(10) Patent No.: US 6,565,231 B1
(45) Date of Patent: May 20, 2003

(54) OLED AREA ILLUMINATION LIGHTING APPARATUS

(75) Inventor: Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/156,442

(22) Filed: May 28, 2002

(51) Int. Cl.[7] ..... H01R 33/00

(52) U.S. Cl. ..... 362/226; 362/249; 362/84; 362/227; 313/504; 313/512; 428/690

(58) Field of Search ..... 362/226, 227, 362/255, 800, 249, 84; 313/499, 504, 505, 512; 428/690, 691; 257/51.049; 439/377, 526, 525

(56) References Cited

U.S. PATENT DOCUMENTS

| | | | | |
|---|---|---|---|---|
| 4,769,292 A | | 9/1988 | Tang et al. | 428/690 |
| 5,061,569 A | | 10/1991 | VanSlyke et al. | 428/457 |
| 5,844,362 A | * | 12/1998 | Tanabe et al. | 313/506 |
| 5,903,102 A | * | 5/1999 | Klappert et al. | 313/512 |
| 6,124,672 A | * | 9/2000 | Burke | 313/506 |
| 6,168,282 B1 | | 1/2001 | Chien | 362/84 |

FOREIGN PATENT DOCUMENTS

| | | |
|---|---|---|
| EP | 1 120 838 A2 | 8/2001 |
| WO | 99/57945 | 11/1999 |

* cited by examiner

*Primary Examiner*—Sandra O'Shea
*Assistant Examiner*—Ali Alavi
(74) *Attorney, Agent, or Firm*—Thomas H. Close

(57) ABSTRACT

A solid-state area illumination lighting apparatus, including a plurality of light sources, each light source having, a substrate; an organic light emitting diode (OLED) layer deposited upon the substrate, the organic light emitting diode layer including first and second electrodes for providing electrical power to the OLED layer; an encapsulating cover covering the OLED layer; and first and second conductors located on the substrate and electrically connected to the first and second electrodes, and extending beyond the encapsulating cover for making electrical contact to the first and second electrodes by an external power source; and a lighting fixture for removably receiving and holding the plurality of light sources and having a plurality of first electrical contacts for making electrical connection to the first and second conductors of the light sources, and second electrical contacts for making electrical connection to an external power source.

26 Claims, 14 Drawing Sheets

OLED AREA ILLUMINATION LIGHTING APPARATUS

FIELD OF THE INVENTION

The present invention relates to the use of organic light emitting diode devices for area illumination.

BACKGROUND OF THE INVENTION

Solid-state lighting devices made of light emitting diodes are increasingly useful for applications requiring robustness and long-life. For example, solid-state LEDs are found today in automotive applications. These devices are typically formed by combining multiple, small LED devices providing a point light source into a single module together with glass lenses suitably designed to control the light as is desired for a particular application (see, for example WO99/57945, published Nov. 11, 1999). These multiple devices are expensive and complex to manufacture and integrate into single area illumination devices. Moreover, LED devices provide point sources of light, a plurality of which are employed for area illumination.

Organic light emitting diodes (OLEDs) are manufactured by depositing organic semiconductor materials between electrodes on a substrate. This process enables the creation of light sources having extended surface area on a single substrate. The prior art describes the use of electro-luminescent materials as adjuncts to conventional lighting (for example U.S. Pat. No. 6,168,282 issued Jan. 2, 2001 to Chien). In this case, because of the limited light output from the electro-luminescent material, it is not useful for primary lighting.

EP1120838A2, published Aug. 1, 2001, describes a method for mounting multiple organic light emitting devices on a mounting substrate to create a light source. However, this approach of mounting multiple light sources on a substrate increases the complexity and hence the manufacturing costs of the area illumination light source. Moreover, in this design the multiple substrates are not readily replaced by consumers if they should fail. In addition, each lighting device must be readily and safely replaced by consumers at minimal cost.

There is a need therefore for an improved, replaceable OLED area illumination device having a simple construction using a single substrate and compatibility with the existing lighting infrastructure.

SUMMARY OF THE INVENTION

The need is met according to the present invention by providing a solid-state area illumination lighting apparatus that includes a plurality of light sources, each light source having, a substrate; an organic light emitting diode (OLED) layer deposited upon the substrate, the organic light emitting diode layer including first and second electrodes for providing electrical power to the OLED layer; an encapsulating cover covering the OLED layer; and first and second conductors located on the substrate and electrically connected to the first and second electrodes, and extending beyond the encapsulating cover for making electrical contact to the first and second electrodes by an external power source; and a lighting fixture for removably receiving and holding the plurality of light sources and having a plurality of first electrical contacts for making electrical connection to the first and second conductors of the light sources, and second electrical contacts for making electrical connection to an external power source.

ADVANTAGES

The present invention has the advantage of providing a fixture together with inexpensive, long-lived, highly efficient light sources that are replaceable, and are compatible with the existing lighting infrastructure and requirements.

It will be understood that the figures are not to scale since the individual layers are too thin and the thickness differences of various layers too great to permit depiction to scale.

DETAILED DESCRIPTION OF THE INVENTION

It is difficult to manufacture large, flat-panel area illumination devices. Large substrates require manufacturing facilities capable of handling large substrates and increase the likelihood of failure due to handling, use, or environment effects. In contrast, the use of smaller, multiple replaceable elements within a single fixture requires less expensive materials, simpler manufacturing processes, and is more robust in the presence of failure, since a single element failure does not cause an entire area illumination device to fail and a single element may be replaced at lower cost. Moreover, multiple, smaller elements are more readily transported. However, this design approach does require the use of fixtures capable of properly aligning, accessing, and providing power to multiple display elements.

Figure 1:
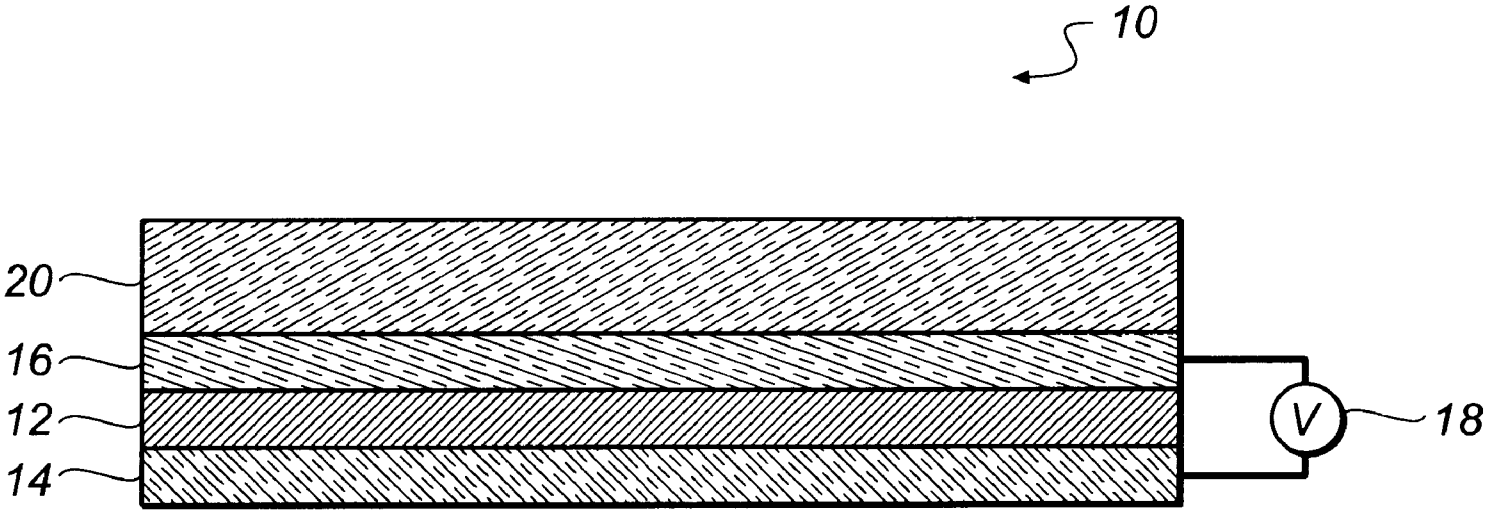
FIG. 1 (PRIOR ART)
FIG. 1 illustrates a cross sectional view of a prior art conventional OLED illumination device.

FIG. 1 is a schematic diagram of a prior art OLED light source including an organic light emitting layer 12 disposed between two electrodes, e.g. a cathode 14 and an anode 16. The organic light emitting layer 12 emits light upon application of a voltage from a power source 18 across the electrodes. The OLED light source 10 typically includes a substrate 20 such as glass or plastic. It will be understood that the relative locations of the anode 16 and cathode 14 may be reversed with respect to the substrate. The term OLED light source refers to the combination of the organic light emitting layer 12, the cathode 14, the anode 16, and other layers described below.

Figure 2:
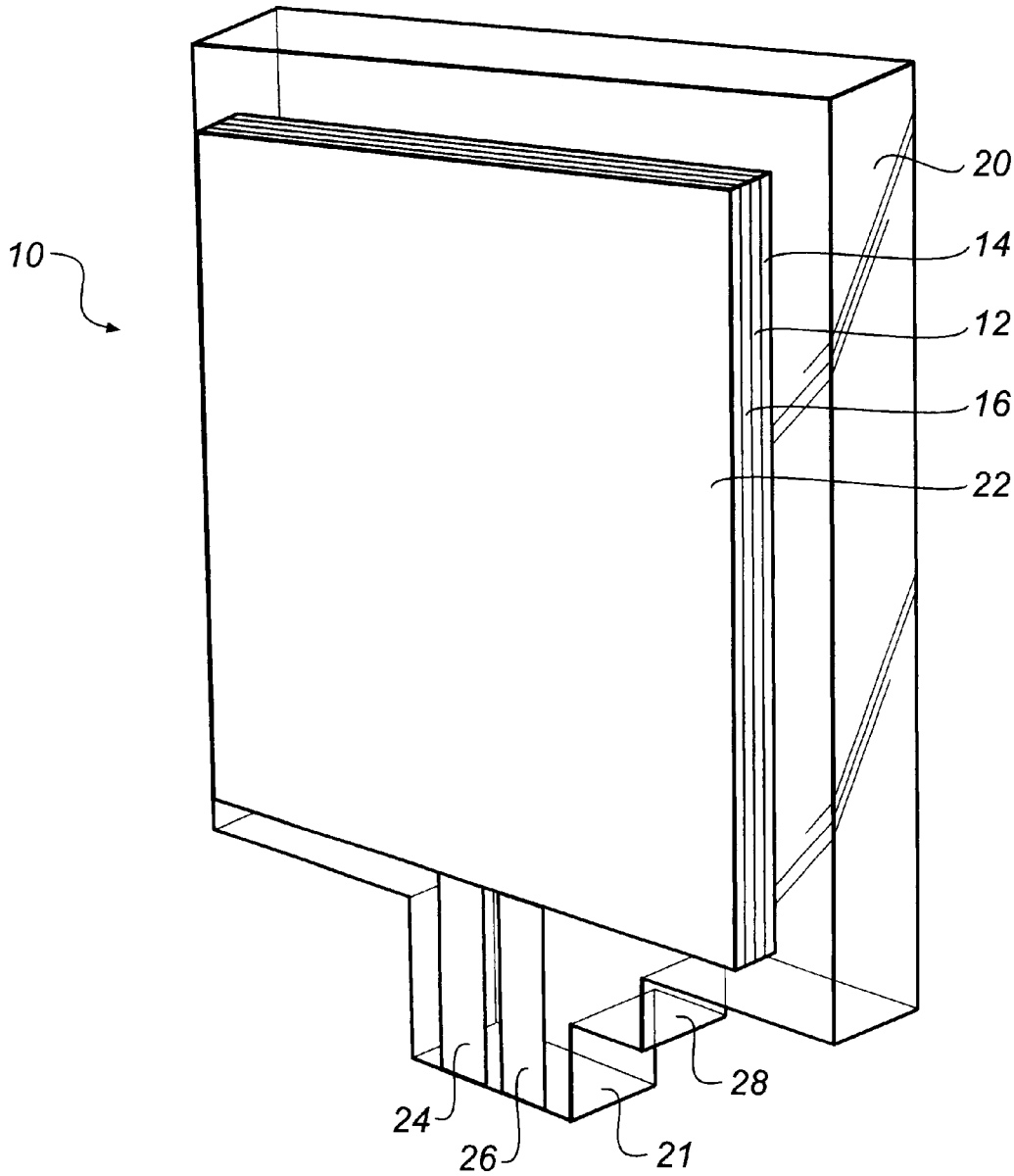
FIG. 2 is a perspective view of a light source useful with the present invention.

Referring to FIG. 2, an OLED light source 10 useful with lighting apparatus according to the present invention includes a substrate 20, the substrate defining a tab portion 21. An organic light emitting layer 12 is disposed between a cathode 14 and an anode 16. An encapsulating cover 22 is provided over the light source 10 on the substrate 20.

The cover 22 may be a separate element such as a hermetically sealed cover plate affixed over the layers 12, 14, and 16 or the cover may be coated over the layers 12, 14, and 16 as an additional layer. The OLED light emitting layer 12 is continuous over the substrate to provide a continuous light emitting area. First and second conductors 24 and 26 located on the substrate 20 are electrically connected to the first and second electrodes 14 and 16, and extend on tab portion 21 beyond the encapsulating cover 22 for making electrical contact to the first and second electrodes by an external power source (not shown).

In a preferred embodiment of the present invention, the tab portion 21 defines an orientation feature such as step 28 to insure that the illumination source is inserted in a lighting fixture (described below) in the correct orientation. To allow light to be emitted from the OLED light source 10, the substrate 20, the electrodes 14 and 16, and the cover 22 are transparent. In applications where it is not required to emit light from both sides of the substrate, one or more of the substrate, cover, anode, or cathode may be opaque or reflective. The cover and/or substrate may also be light diffusers.

Figure 3:
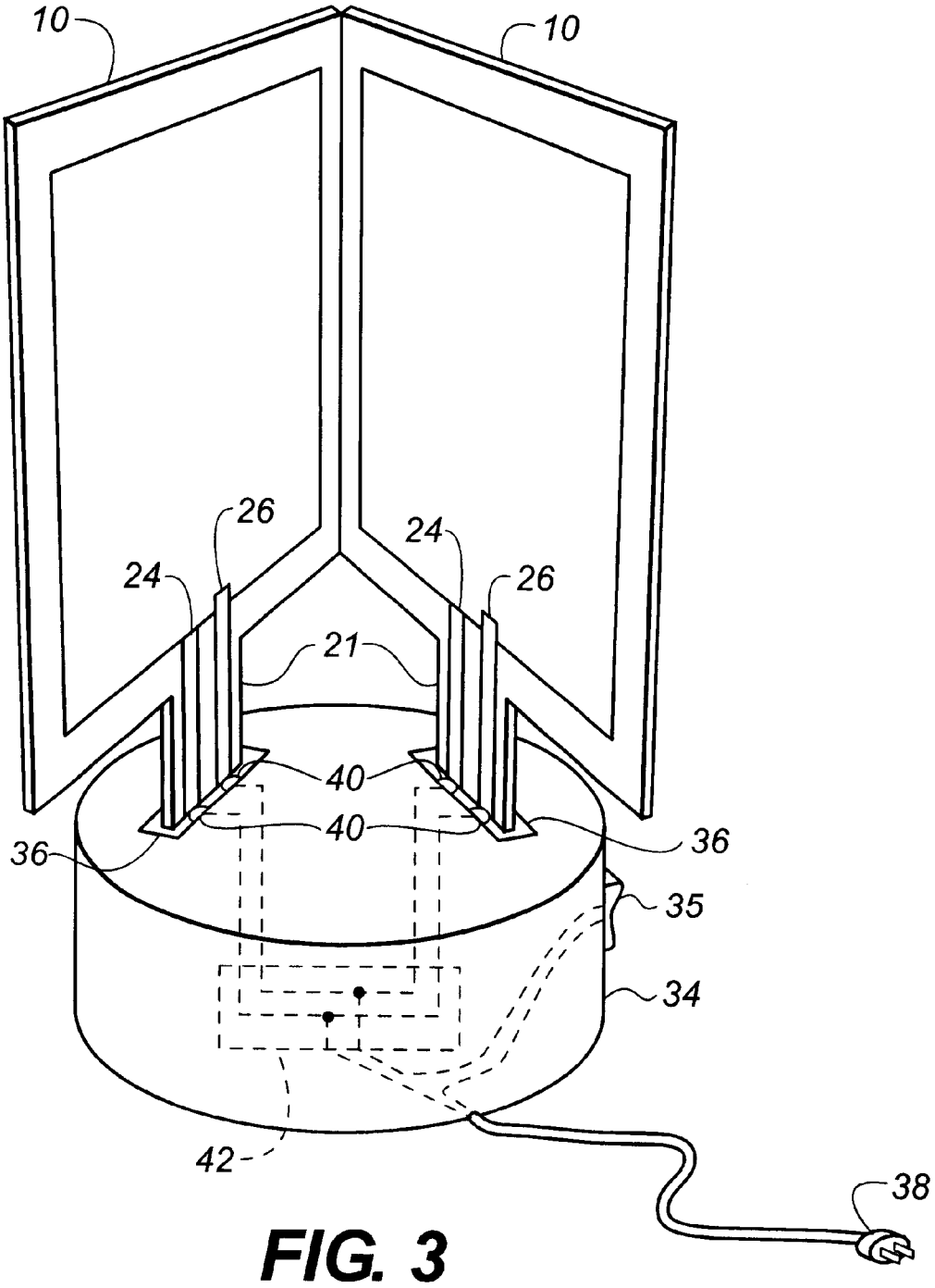
FIG. 3 is a perspective view of a lighting apparatus according to one embodiment of the present invention.

Referring to FIG. 3, according to the present invention, a plurality of light sources 10 are held in a lighting fixture 34. The lighting fixture 34 includes a plurality of apertures 36 for receiving the respective tab portions 21 of the light sources 10 and includes set of first electrical contacts 40 located in the apertures 36 for making electrical connection to the first and second conductors 24 and 26 of each of the light sources 10. The lighting fixture 34 also includes second electrical contacts 38 which are electrically connected to first electrical contacts 40 for making electrical connection to an external power source (not shown).

Duplicate first electrical contacts may be provided in the aperture 36 so that the tab portion 21 (assuming it does not include an orientation feature 28) may be inserted in either orientation into the aperture 36 and will still connect appropriately to the external power source. The light source 10 is physically inserted into or removed from the lighting fixture 34 by pushing or pulling the tab portion of the substrate into or out of the lighting fixture 34. The light source 10 and the lighting fixture 34 are preferably provided with a detent (not shown) to hold the light source 10 in the fixture 34.

The light source 10 may be replaced by physically removing it from the fixture 34 by pulling the light source 10 out of the fixture 34 and inserting a replacement light source 10, properly aligned, into the fixture 34. The fixture 34 may be designed so that the light source cannot be inserted into the fixture backwards using techniques well known in the art. Hence, the lighting apparatus is well adapted to consumer use.

The lighting fixture may include a power converter 42 to convert the electrical power from the external power source to a form suitable for powering the OLED light source 10. In a preferred embodiment, the external power source is a standard power source, for example, the power supplied to a house or office at 110 V in the United States or 220 V in the United Kingdom. Other standards such as 24 V DC, 12 V DC and 6 V DC found in vehicles, for example, may also be used.

The OLED light source 10 may require a rectified voltage with a particular waveform and magnitude; the converter 42 can provide the particular waveform using conventional power control circuitry. The particular waveform may periodically reverse bias the light emitting organic materials to prolong the life-time of the OLED materials in the light source 10. The converter 42 is preferably located in the lighting fixture 34, as shown in FIG. 3. The lighting fixture 34 may also include a switch 35 for controlling the power to the light source 10.

Figure 4:
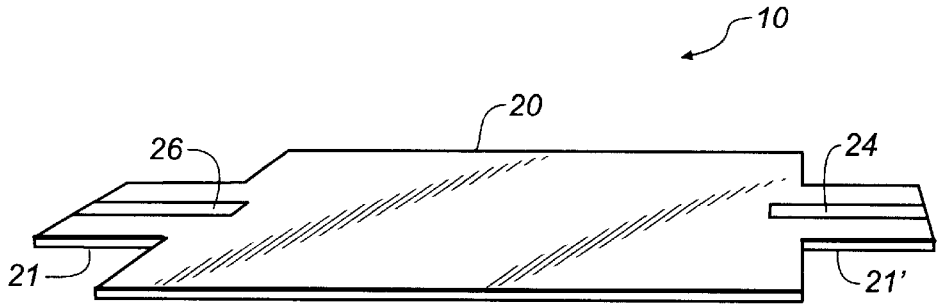
FIG. 4 is a perspective view of an alternative light source useful with the present invention.
Figure 5:
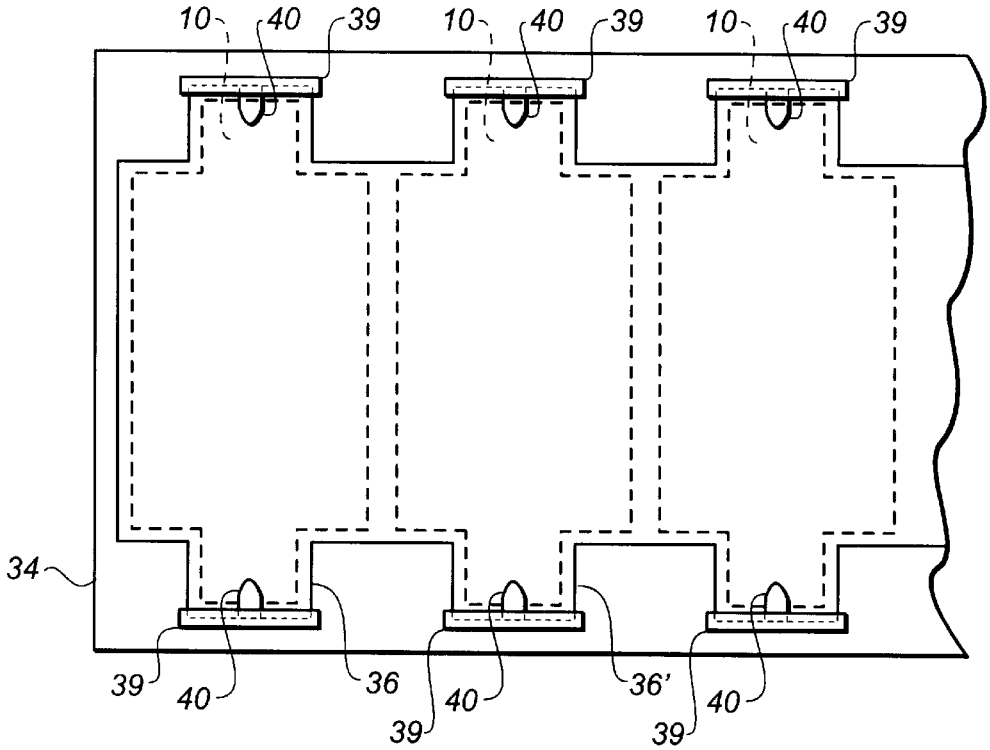
FIG. 5 is a top view of a lighting fixture used with the light source shown in FIG. 4 according to an alternative embodiment of the present invention.

FIG. 4 illustrates an alternative embodiment of a light source useful with the present invention wherein the substrate 20 has a long thin body portion with two tabs 21 and 21' located at opposite ends of the body portion, one of the conductors 24 and 26 being located on each tab. Referring to FIG. 5, a lighting fixture 34 includes a plurality of apertures 36 and 36' for receiving and holding the respective tabs of the light sources shown in FIG. 4. The light sources can be held in the fixture by detents or clips 39 in the apertures.

Figure 6:
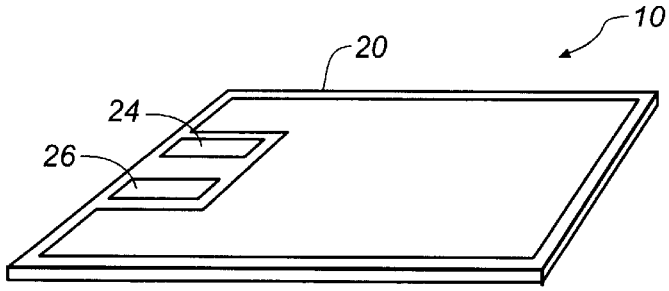
FIG. 6 is a perspective view of an alternative light source useful with the present invention.
Figure 7:
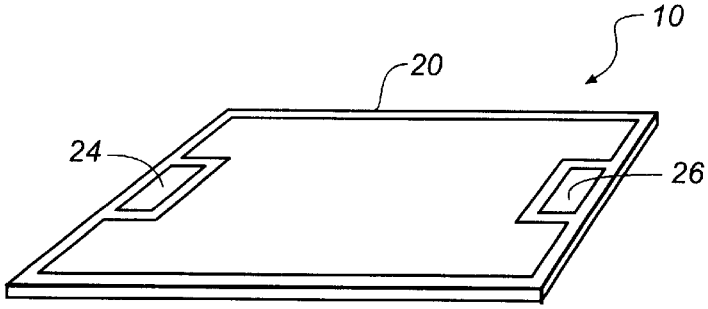
FIG. 7 is a perspective view of an alternative light source useful with the present invention.

Referring to FIG. 6, in a further alternative embodiment of the light source 10 useful in the lighting apparatus of the present invention, the substrate 20 does not include a tab portion, and the first and second conductors are located on the edge of the substrate 20. The light source 10 includes a substrate 20 with first and second conductors 24 and 26 located on the edge of the substrate 20. FIG. 7 illustrates a further alternative arrangement wherein the first and second conductors 24 and 26 are located at opposite edges of the substrate 20. The light source 10 may emit light from only one side (e.g. the side facing away from the lighting fixture) and the first and second conductors located on the opposite side.

The substrate 20 can be either rigid or flexible. Rigid substrates, such as glass, provide more structural strength and may have a variety of shapes other than rectangular. The present invention may also be used with a flexible substrate, such as plastic, that can be bent into a variety of shapes. In the case wherein the substrate is flexible, the lighting fixture 34 may include a support to hold the substrate in a desired configuration, for example, as shown in FIG. 7, a plurality of light sources 10 are curved into a cylindrical shape and supported by lighting fixture 34. Electrical power is provided to the lighting fixture and conducted to the light sources 10 through contacts in apertures 36 in the lighting fixture 34.

Figure 8:
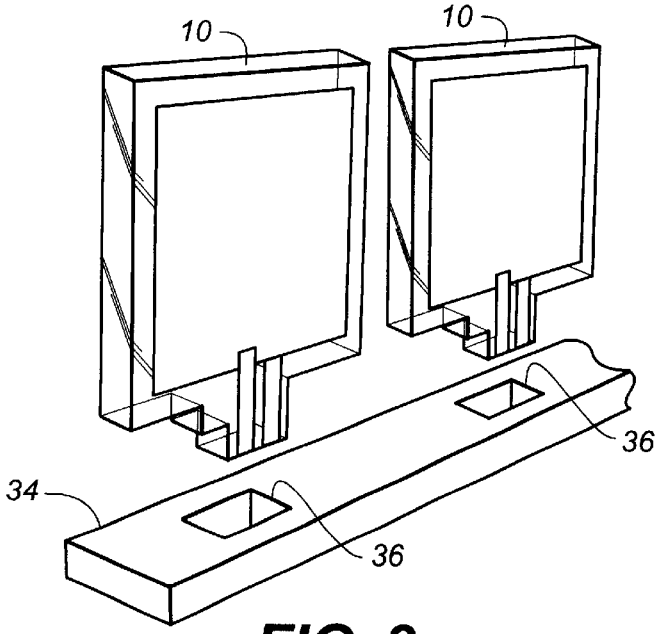
FIG. 8 is a perspective view of a lighting apparatus according to a further alternative embodiment of the present invention.
Figure 9:
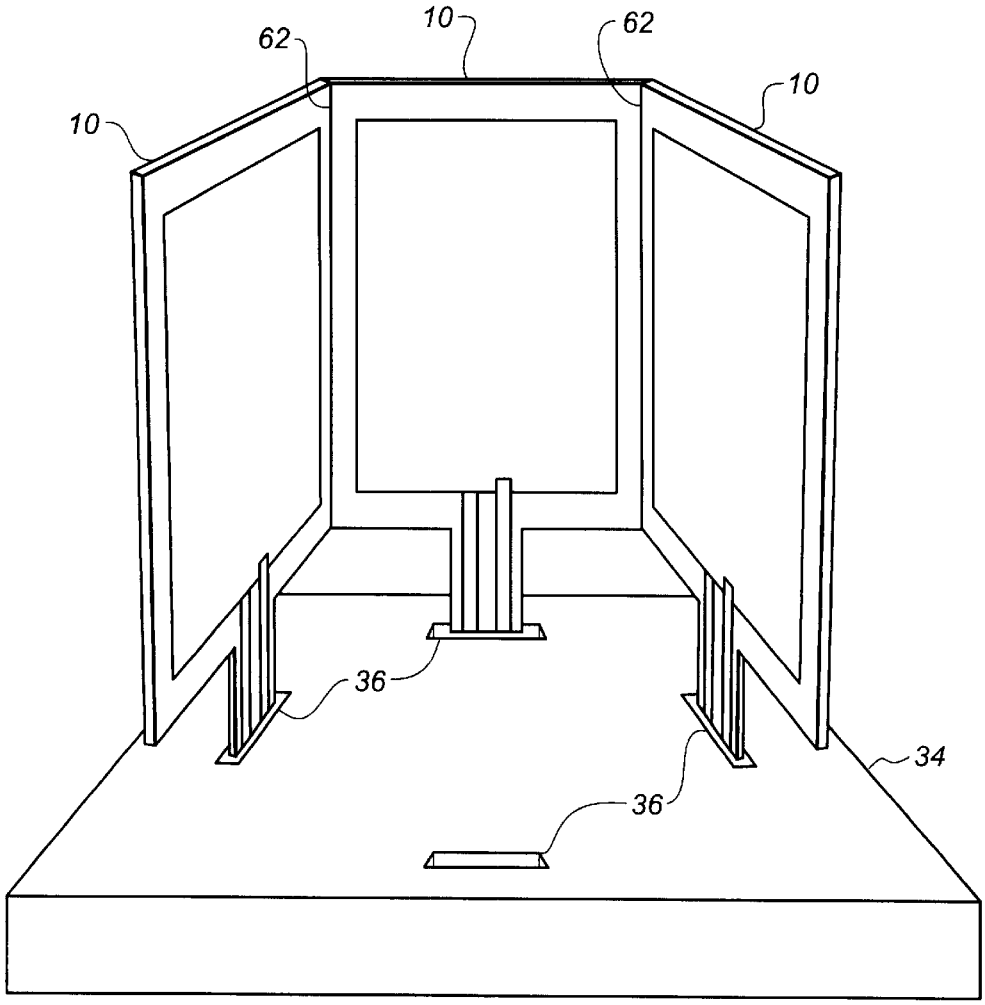
FIG. 9 is a perspective view of lighting apparatus according to a further alternative embodiment of the present invention.

A great variety of decorative and special-purpose effects are readily created by the use of multiple light sources in a single lighting fixture. Directional lighting is readily achieved by providing rectangular substrates mounted so that the substrates have an edge in common (touching, or nearly touching). Referring to FIG. 8, a lighting fixture 34 includes multiple apertures 36 for a plurality of light sources 10 arranged in a row. The light sources each have an edge touching or nearly touching the neighboring light sources and are in a common plane. Multiple rows of light sources may be included in a single fixture (not shown). The edges not in common may form a line (as in FIG. 8) or the edges of an open polygon as in FIG. 3. In the lighting apparatus of FIG. 3, light may be emitted and reflected from the inside of the angle or emitted from the outside. This concept is readily extended to a closed polygon such as is shown in FIG. 9 (with one light source omitted for clarity) wherein the light sources may emit light to the inside of the closed polygon, the outside, or both.

Figure 10A:
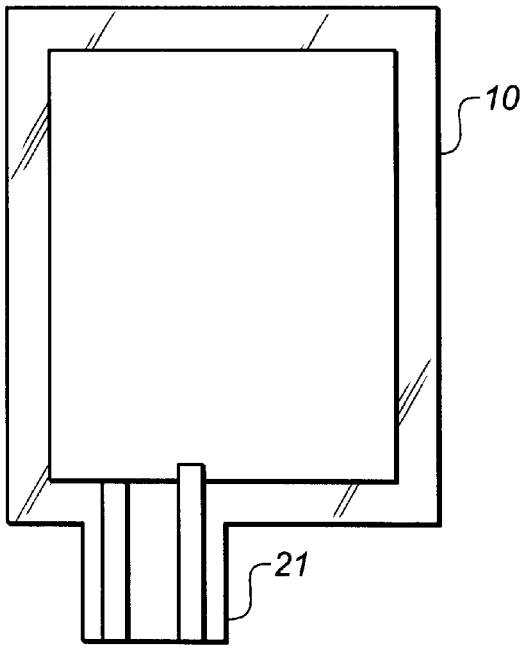
FIGS. 10A–D are perspective views of a lighting apparatus according to a further alternative embodiment of the present invention.
Figure 10B:
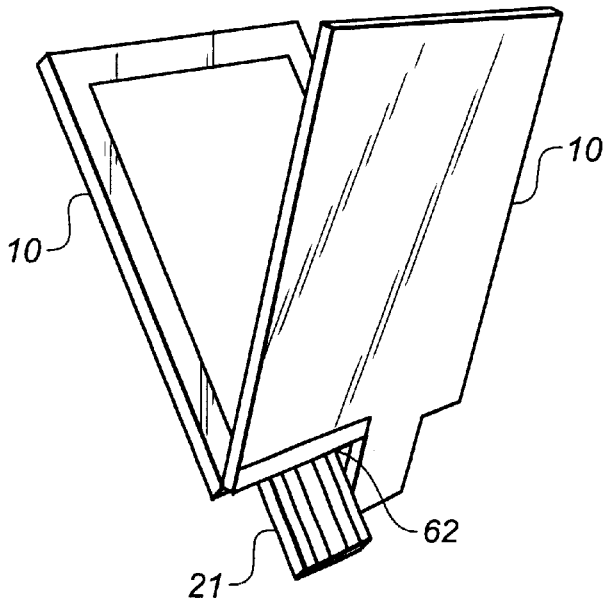
Figure 10C:
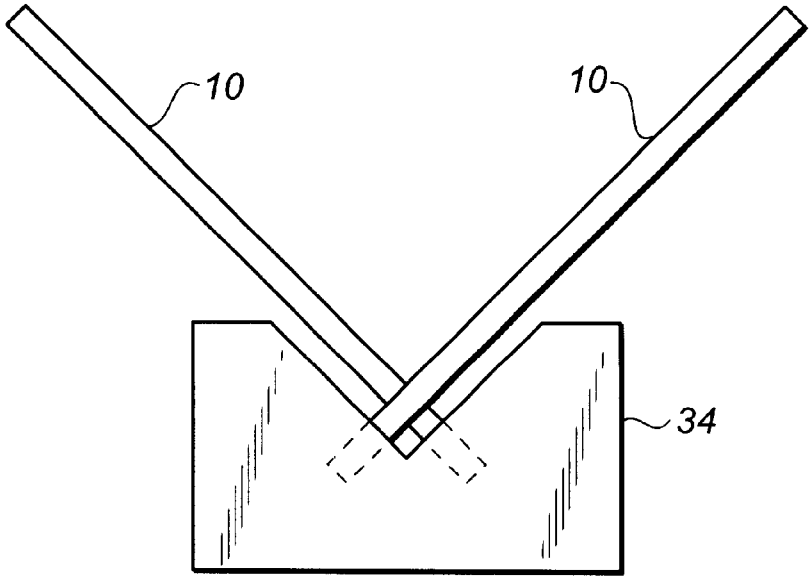
Figure 10D:
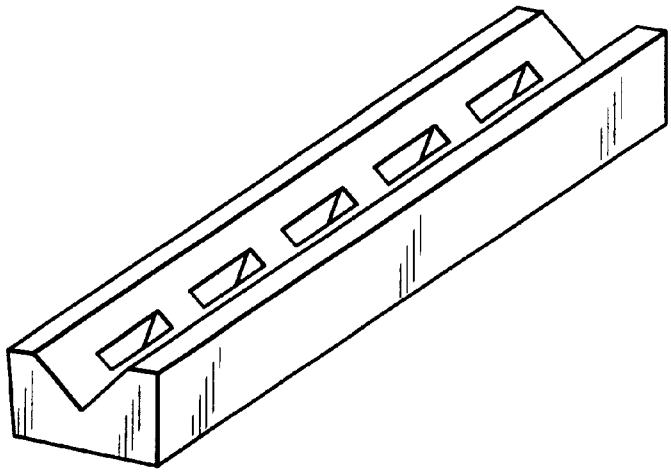

Alternatively, multiple rows of light sources may be aligned at an angle to each other, as shown in FIGS. 10A–D. Light sources 10 may be provided with a reflective back surface. Light emitted from each light source 10 may be reflected from the other so as to reduce the aperture from which the light is emitted from the light sources. In this case, light sources 10 with reflective backs are preferred. Referring to FIG. 10A, substrates with a tab 21 of one half the width of the light source 10 can be combined in pairs (see FIG. 10B) wherein each substrate is in a different plane but sharing a common edge 62 near the tab 21 on each substrate. As shown in FIG. 10C, the pairs can be inserted at an angle into a single lighting fixture 34. These pairs of light sources can then be replicated along the length of a long lighting fixture 34 to provide lighting apparatus of any desired length (see FIG. 10D) wherein the light sources conceal the lighting fixture. A plurality of lighting fixtures of the type shown in FIGS. 10A–D can then be provided in an array to form a panel, for example in a suspended ceiling. This provides a nearly flat-panel area illuminator. The angle at which the pairs are placed controls the narrowness of the illumination aperture, the depth of the flat panel, and the width of the row. By inter-digitating the light sources, the fixture is hidden. Each element of each pair can be easily replaced in the fixture in the event of a failure. By connecting the light sources in parallel with the others, a robust, gracefully degrading lighting fixture is created.

Figure 11A:
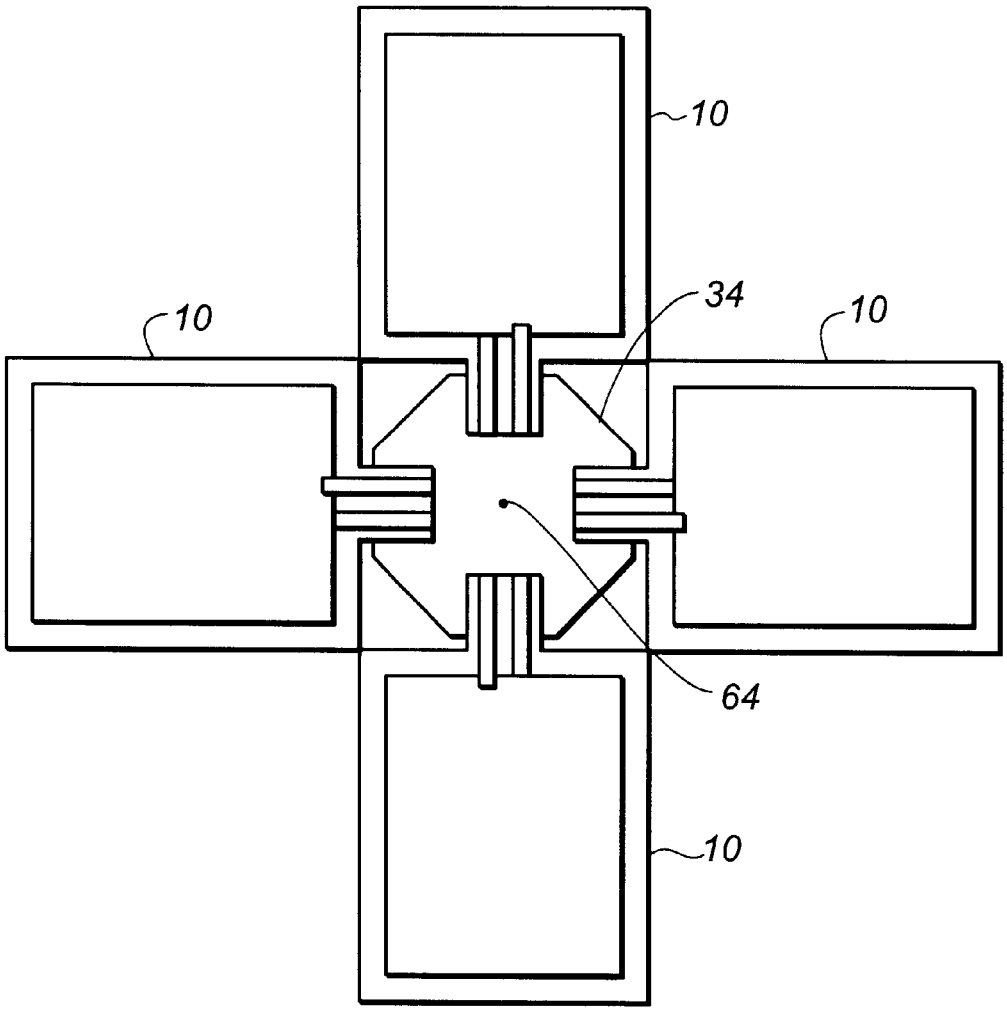
FIGS. 11A–C are plan views of a lighting apparatus having light sources arranged in a variety of fan shaped configurations according to one embodiment of the present invention.
Figure 11B:
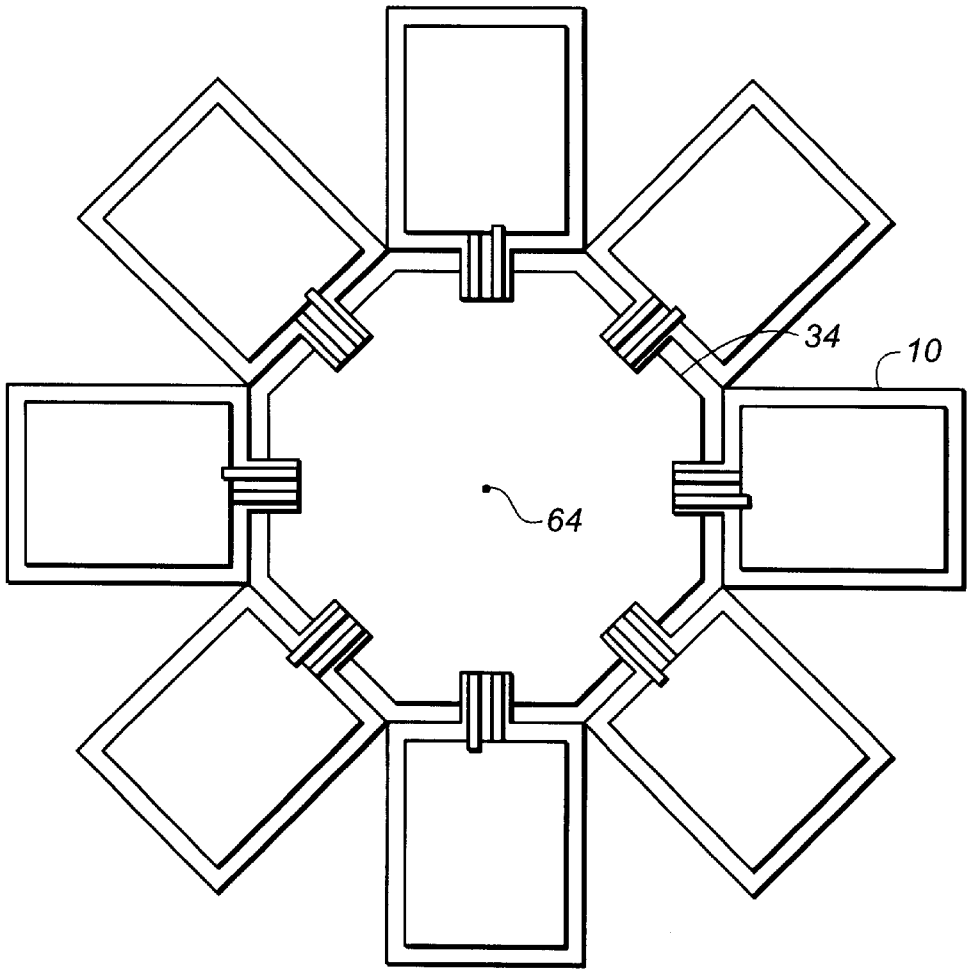
Figure 11C:
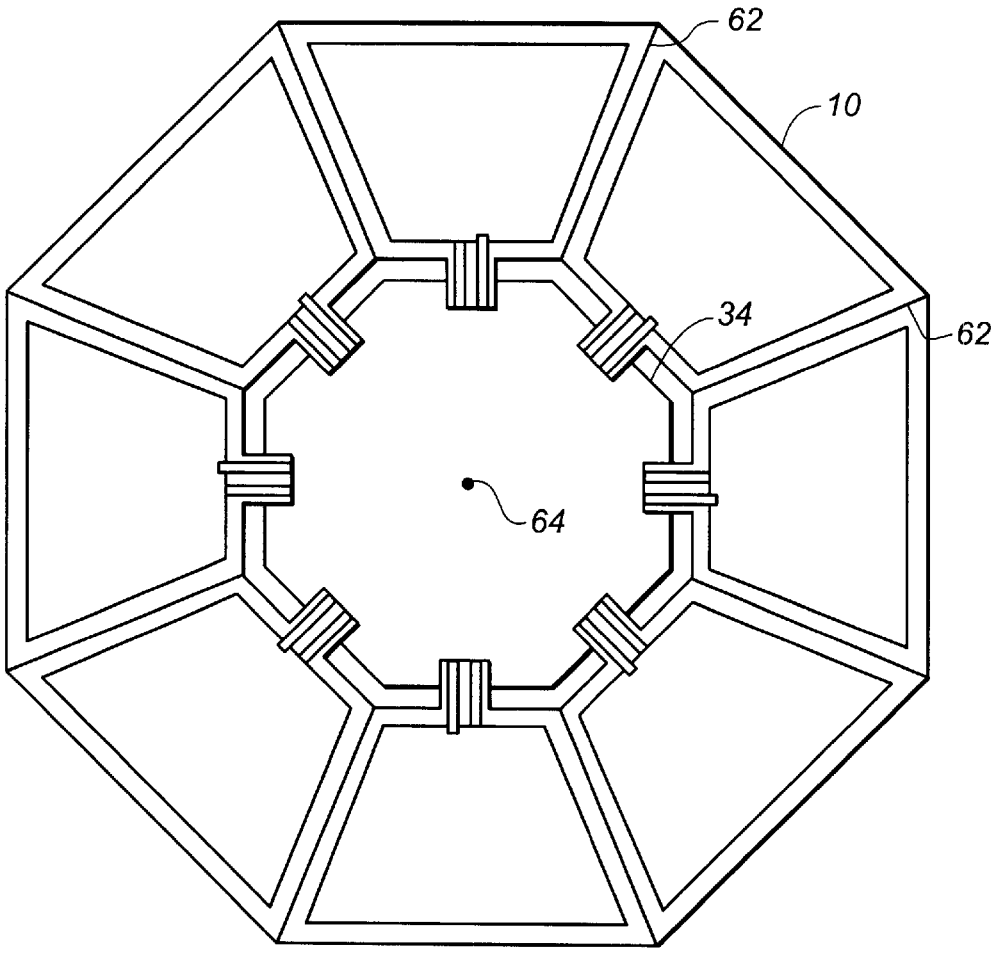

Referring to FIGS. 11 A, B and C, in an alternative embodiment, a plurality of light emitting devices 10 are arranged in a common plane with the tabs pointing toward a common center 64. If the light sources 10 are trapezoidal in shape, the edges can be contiguous so that the outside and inside edges of the substrates form a trapezoid and the light emitting surfaces are contiguous, as shown in FIG. 11 C.

If the light sources are each slightly tilted in a common orientation, the light sources form a fan shape and may be rotated about a common point to provide a functional fan.

Figure 12:
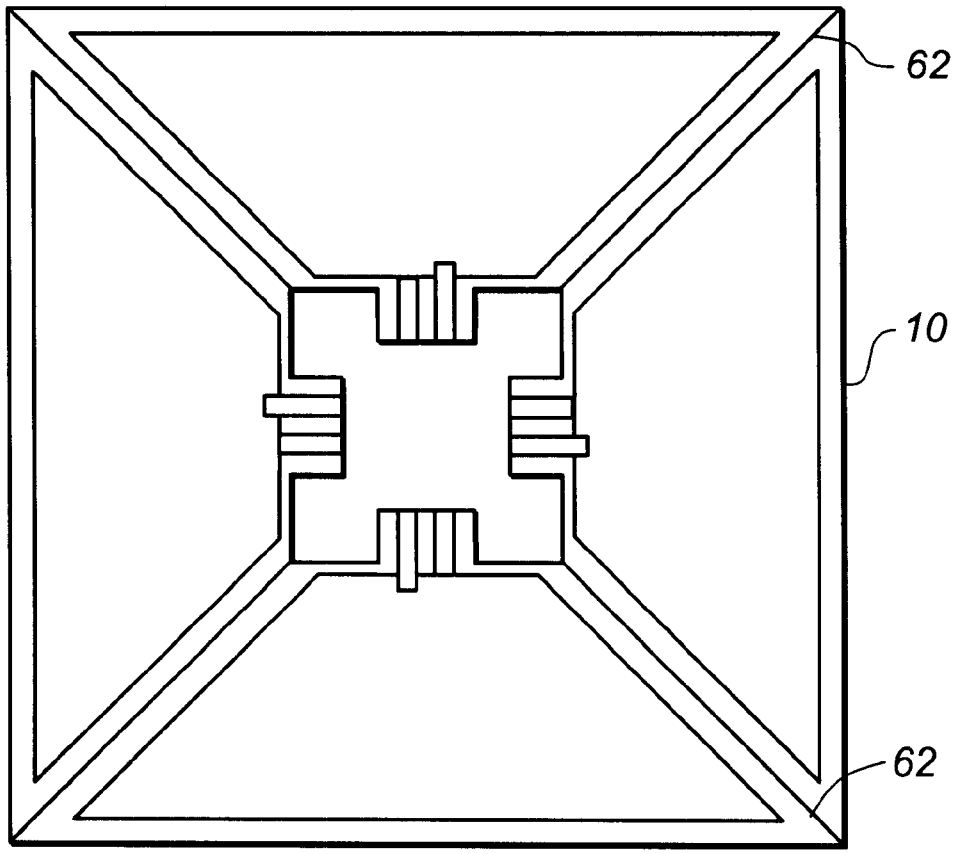
FIG. 12 is a plan view of a lighting apparatus having light sources arranged in a pyramidal arrangement.

The light sources may also be aligned so that the outside edge of each substrate forms a regular polygon in a common plane and the substrates themselves are at a common angle to the plane to form a three dimensional shape such as a polygonal cone as shown in FIG. 12. If the light sources are trapezoidal, the side edges may be joined to form an enclosing structure from one end of which the light is emitted and at the other end of which the tabs are inserted into the lighting fixture.

Three substrates may also be arranged so that each substrate is in a different plane orthogonal to the other to form a corner cube. If the light sources have a reflective back, any light shone towards the corner cube may be reflected back whence the light came.

Figure 13:
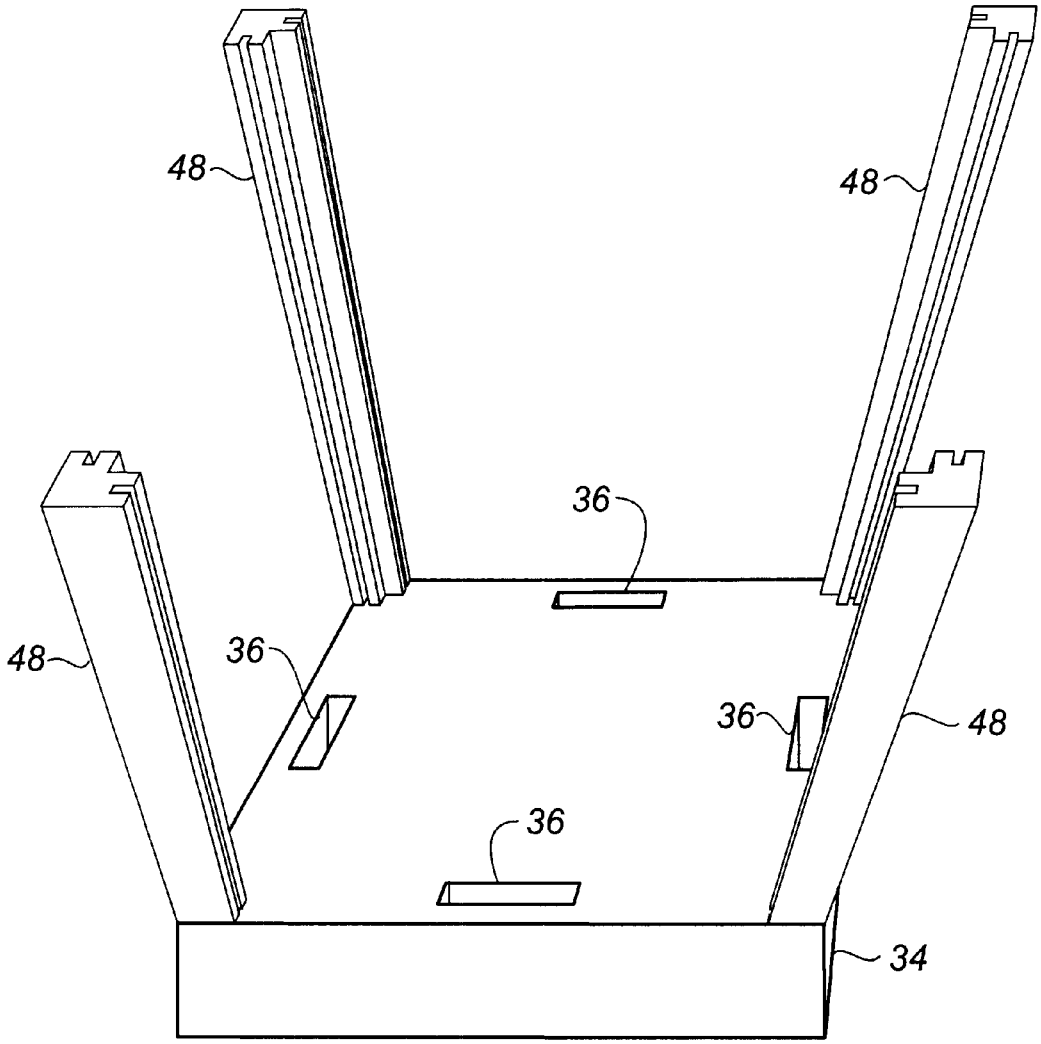
FIG. 13 is a perspective view of a lighting fixture having decorative channels for receiving the edges of light sources according to one embodiment of the present invention.

Referring to FIG. 13, lighting fixtures in which the edges of the light sources are touching in a common line (or nearly touching) can include decorative channels 48 similar to stained glass caming to improve their aesthetic appearance, to hold the substrates in alignment. The light sources useful in the present invention may also be provided with decorative substrates or encapsulating covers may be painted or composed of colored material to provide a stained glass look. Alternatively, patterns may be cut or etched into the surfaces of the substrate and/or cover to provide pleasing patterns, graphic elements such as logos or pictures, or light refractive properties.

In a preferred embodiment, the OLED layer comprises Organic Light Emitting Diodes (OLEDs) which are composed of small molecule OLEDs as disclosed in but not limited to U.S. Pat. No. 4,769,292, issued Sep. 6, 1988 to Tang et al., and U.S. Pat. No. 5,061,569, issued Oct. 29, 1991 to VanSlyke et al.

Further details with regard to OLED materials and construction are described below.

OLED Element Architecture

Figure 14:
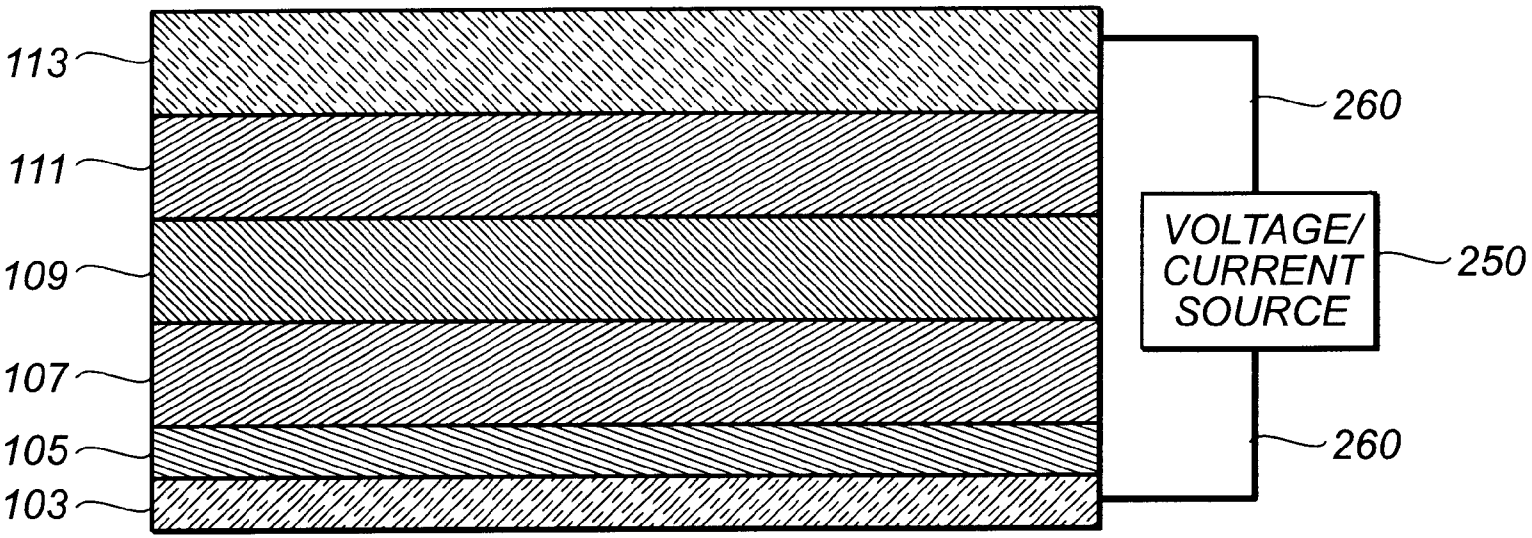
FIG. 14 is a cross sectional view of an OLED light source as known in the prior art.

There are numerous configurations of OLED elements wherein the present invention can be successfully practiced. A typical, non-limiting structure is shown in FIG. 14 and is comprised of an anode layer 103, a hole-injecting layer 105, a hole-transporting layer 107, a light-emitting layer 109, an electron-transporting layer 111, and a cathode layer 113. These layers are described in detail below. The total combined thickness of the organic layers is preferably less than 500 nm. A voltage/current source 250 is required to energize the OLED element and conductive wiring 260 is required to make electrical contact to the anode and cathode.

Substrate

Substrate 20 is preferably light transmissive but may also be opaque or reflective. Substrates for use in this case include, but are not limited to, glass, plastic, semiconductor materials, ceramics, and circuit board materials.

Anode

The anode layer 103 is preferably transparent or substantially transparent to the light emitted by the OLED layer(s). Common transparent anode materials used in this invention are indium-tin oxide (ITO), indium-zinc oxide (IZO) and tin oxide, but other metal oxides can work including, but not limited to, aluminum- or indium-doped zinc oxide, magnesium-indium oxide, and nickel-tungsten oxide. In addition to these oxides, metal nitrides, such as gallium nitride, and metal selenides, such as zinc selenide, and metal sulfides, such as zinc sulfide, can be used in layer 103. When the anode is not transparent, the light transmitting characteristics of layer 103 are immaterial and any conductive material can be used, transparent, opaque or reflective. Example conductors for this application include, but are not limited to, gold, iridium, molybdenum, palladium, and platinum. Typical anode materials, transmissive or otherwise, have a work function of 4.1 eV or greater. Desired anode materials are commonly deposited by any suitable means such as evaporation, sputtering, chemical vapor deposition, or electrochemical means. Anodes can be patterned using well-known photolithographic processes.

Hole-Injecting Layer (HIL)

It is often useful that a hole-injecting layer 105 be provided between anode 103 and hole-transporting layer 107. The hole-injecting material can serve to improve the film formation property of subsequent organic layers and to facilitate injection of holes into the hole-transporting layer. Suitable materials for use in the hole-injecting layer include, but are not limited to, porphyrinic compounds as described in U.S. Pat. No. 4,720,432, and plasma-deposited fluorocarbon polymers as described in U.S. Pat. No. 6,208,075. Alternative hole-injecting materials reportedly useful in organic EL devices are described in EP 0 891 121 A1 and EP 1 029 909 A1.

Hole-Transporting Layer (HTL)

The hole-transporting layer 107 contains at least one hole-transporting compound such as an aromatic tertiary amine, where the latter is understood to be a compound containing at least one trivalent nitrogen atom that is bonded only to carbon atoms, at least one of which is a member of an aromatic ring. In one form the aromatic tertiary amine can be an arylamine, such as a monoarylamine, diarylamine, triarylamine, or a polymeric arylamine. Exemplary monomeric triarylamines are illustrated by Klupfel et al. U.S. Pat. No. 3,180,730. Other suitable triarylamines substituted with one or more vinyl radicals and/or comprising at least one active hydrogen containing group are disclosed by Brantley et al U.S. Pat. Nos. 3,567,450 and 3,658,520. A more preferred class of aromatic tertiary amines are those which include at least two aromatic tertiary amine moieties as described in U.S Pat. Nos. 4,720,432 and 5,061,569. Illustrative of useful aromatic tertiary amines include, but are not limited to, the following:

1,1-Bis(4-di-p-tolylaminophenyl)cycloexane
1,1-Bis(4-di-p-tolylaminophenyl)-4-phenylcyclohexane
4,4'-Bis(diphenylamino)quadriphenyl
Bis(4-dimethylamino-2-methylphenyl)-phenylmethane
N,N,N-Tri(p-tolyl)amine
4-(di-p-tolylamino)4'-[4(di-p-tolylamino)-styryl]stilbene
N,N,N',N'-Tetra-p-tolyl-4-4'-diaminobiphenyl
N,N,N',N'-Tetraphenyl-4,4'-diaminobiphenyl
N,N,N',N'-tetra-1-naphthyl-4,4'-diaminobiphenyl
N,N,N',N'-tetra-2-naphthyl-4,4'-diaminobiphenyl
N-Phenylcarbazole
4,4'-Bis[N-(1-naphthyl)-N-phenylamino]biphenyl
4,4'-Bis[N-(1-naphthyl)-N-(2-naphthyl)amino]biphenyl
4,4"-Bis[N-(1-naphthyl)-N-phenylamino]p-terphenyl
4,4'-Bis[N-(2-naphthyl)-N-phenylamino]biphenyl
4,4'-Bis[N-(3-acenaphthenyl)-N-phenylamino]biphenyl
1,5-Bis[N-(1-naphthyl)-N-phenylamino]naphthalene
4,4'-Bis[N-(9-anthryl)-N-phenylamino]biphenyl
4,4"-Bis [N-(1-anthryl)-N-phenylamino]-p-terphenyl
4,4'-Bis[N-(2-phenanthryl)-N-phenylamino]biphenyl
4,4'-Bis[N-(8-fluoranthenyl)-N-phenylamino]biphenyl
4,4'-Bis[N-(2-pyrenyl)-N-phenylamino]biphenyl
4,4'-Bis[N-(2-naphthacenyl)-N-phenylamino]biphenyl
4,4'-Bis[N-(2-perylenyl)-N-phenylamino]biphenyl
4,4'-Bis[N-(1-coronenyl)-N-phenylamino]biphenyl
2,6-Bis(di-p-tolylamino)naphthalene
2,6-Bis[di-(1-naphthyl)amino]naphthalene
2,6-Bis[N-(1-naphthyl)-N-(2-naphthyl)amino]naphthalene
N,N,N',N'-Tetra(2-naphthyl)-4,4"-diamino-p-terphenyl
4,4'-Bis {N-phenyl-N-[4-(1-naphthyl)-phenyl] amino}biphenyl
4,4'-Bis[N-phenyl-N-(2-pyrenyl)amino]biphenyl
2,6-Bis[N,N-di(2-naphthyl)amine]fluorene
1,5-Bis[N-(1-naphthyl)-N-phenylamino]naphthalene Another class of useful hole-transporting materials includes polycyclic aromatic compounds as described in EP 1 009 041. In addition, polymeric hole-transporting materials can be used such as poly(N-vinylcarbazole) (PVK), polythiophenes, polypyrrole, polyaniline, and copolymers such as poly(3,4-ethylenedioxythiophene)/poly(4-styrenesulfonate) also called PEDOT/PSS.

Light-Emitting Layer (LEL)

As more fully described in U.S. Pat. Nos. 4,769,292 and 5,935,721, the light-emitting layer (LEL) 109 of the organic EL element comprises a luminescent or fluorescent material where electroluminescence is produced as a result of electronhole pair recombination in this region. The light-emitting layer can be comprised of a single material, but more commonly consists of a host material doped with a guest compound or compounds where light emission comes primarily from the dopant and can be of any color. The host materials in the light-emitting layer can be an electron-transporting material, as defined below, a hole-transporting material, as defined above, or another material or combination of materials that support hole-electron recombination. The dopant is usually chosen from highly fluorescent dyes, but phosphorescent compounds, e.g., transition metal complexes as described in WO 98/55561, WO 00/18851, WO 00/57676, and WO 00/70655 are also useful. Dopants are typically coated as 0.01 to 10% by weight into the host material. Iridium complexes of phenylpyridine and its derivatives are particularly useful luminescent dopants. Polymeric materials such as polyfluorenes and polyvinylarylenes (e.g., poly(p-phenylenevinylene), PPV) can also be used as the host material. In this case, small molecule dopants can be molecularly dispersed into the polymeric host, or the dopant could be added by copolymerizing a minor constituent into the host polymer.

An important relationship for choosing a dye as a dopant is a comparison of the bandgap potential which is defined as the energy difference between the highest occupied molecular orbital and the lowest unoccupied molecular orbital of the molecule. For efficient energy transfer from the host to the dopant molecule, a necessary condition is that the band gap of the dopant is smaller than that of the host material.

Host and emitting molecules known to be of use include, but are not limited to, those disclosed in U.S. Pat. Nos. 4,769,292, 5,141,671, 5,150,006, 5,151,629, 5,405,709, 5,484,922, 5,593,788, 5,645,948, 5,683,823, 5,755,999, 5,928,802, 5,935,720, 5,935,721, and 6,020,078.

Metal complexes of 8-hydroxyquinoline and similar oxine derivatives constitute one class of useful host compounds capable of supporting electroluminescence, and are particularly suitable. Illustrative of useful chelated oxinoid compounds are the following:

CO-1: Aluminum trisoxine [alias, tris(8-quinolinolato) aluminum(III)]
CO-2: Magnesium bisoxine [alias, bis(8-quinolinolato) magnesium(II)]
CO-3: Bis[benzo{f}-8-quinolinolato]zinc (II)
CO-4: Bis(2-methyl-8-quinolinolato)aluminum(III)-$\mu$-oxo-bis(2-methyl-8-quinolinolato)aluminum(III)
CO-5: Indium trisoxine [alias, tris(8-quinolinolato)indium]
CO-6: Aluminum tris(5-methyloxine) [alias, tris(5-methyl-8-quinolinolato) aluminum(III)]
CO-7: Lithium oxine [alias, (8-quinolinolato)lithium(I)]
CO-8: Gallium oxine [alias, tris(8-quinolinolato)gallium (III)]
CO-9: Zirconium oxine [alias, tetra(8-quinolinolato) zirconium(IV)]

Other classes of useful host materials include, but are not limited to: derivatives of anthracene, such as 9,10-di-(2-naphthyl)anthracene and derivatives thereof, distyrylarylene derivatives as described in U.S. Pat. No. 5,121,029, and benzazole derivatives, for example, 2, 2', 2"-(1,3,5-phenylene)tris [1-phenyl-1H-benzimidazole].

Useful fluorescent dopants include, but are not limited to, derivatives of anthracene, tetracene, xanthene, perylene, rubrene, coumarin, rhodamine, quinacridone, dicyanomethylenepyran compounds, thiopyran compounds, polymethine compounds, pyrilium and thiapyrilium compounds, fluorene derivatives, periflanthene derivatives and carbostyryl compounds.

Electron-Transporting Layer (ETL)

Preferred thin film-forming materials for use in forming the electron-transporting layer 111 of the organic EL elements of this invention are metal chelated oxinoid compounds, including chelates of oxine itself (also commonly referred to as 8-quinolinol or 8-hydroxyquinoline). Such compounds help to inject and transport electrons, exhibit high levels of performance, and are readily fabricated in the form of thin films. Exemplary oxinoid compounds were listed previously.

Other electron-transporting materials include various butadiene derivatives as disclosed in U.S. Pat. No. 4,356,429 and various heterocyclic optical brighteners as described in U.S. Pat. No. 4,539,507. Benzazoles and triazines are also useful electron-transporting materials.

In some instances, layers 111 and 109 can optionally be collapsed into a single layer that serves the function of supporting both light emission and electron transport. These layers can be collapsed in both small molecule OLED systems and in polymeric OLED systems. For example, in polymeric systems, it is common to employ a hole-transporting layer such as PEDOT-PSS with a polymeric light-emitting layer such as PPV. In this system, PPV serves the function of supporting both light emission and electron transport.

Cathode

Preferably, the cathode 113 is transparent and can comprise nearly any conductive transparent material. Alternatively, the cathode 113 may be opaque or reflective. Suitable cathode materials have good film-forming properties to ensure good contact with the underlying organic layer, promote electron injection at low voltage, and have good stability. Useful cathode materials often contain a low work function metal (<4.0 eV) or metal alloy. One preferred cathode material is comprised of a Mg:Ag alloy wherein the percentage of silver is in the range of 1 to 20%, as described in U.S. Pat. No. 4,885,221. Another suitable class of cathode materials includes bilayers comprising a thin electron-injection layer (EIL) and a thicker layer of conductive metal. The EIL is situated between the cathode and the organic layer (e.g., ETL). Here, the EIL preferably includes a low work function metal or metal salt, and if so, the thicker conductor layer does not need to have a low work function. One such cathode is comprised of a thin layer of LiF followed by a thicker layer of Al as described in U.S. Pat. No. 5,677,572. Other useful cathode material sets include, but are not limited to, those disclosed in U.S. Pat. Nos. 5,059,861, 5,059,862, and 6,140,763.

When cathode layer 113 is transparent or nearly transparent, metals must be thin or transparent conductive oxides, or a combination of these materials. Optically transparent cathodes have been described in more detail in U.S Pat. Nos. 4,885,211, 5,247,190, JP 3,234,963, U.S. Pat. Nos. 5,703,436, 5,608,287, 5,837,391, 5,677,572, 5,776,622, 5,776,623, 5,714,838, 5,969,474, 5,739,545, 5,981,306, 6,137,223, 6,140,763, 6,172,459, EP 1 076 368, and U.S. Pat. No. 6,278,236. Cathode materials are typically deposited by evaporation, sputtering, or chemical vapor deposition. When needed, patterning can be achieved through many well known methods including, but not limited to, through-mask deposition, integral shadow masking as described in U.S. Pat. No. 5,276,380 and EP 0 732 868, laser ablation, and selective chemical vapor deposition.

Deposition of Organic Layers

The organic materials mentioned above are suitably deposited through a vapor-phase method such as sublimation, but can be deposited from a fluid, for example, from a solvent with an optional binder to improve film formation. If the material is a polymer, solvent deposition is useful but other methods can be used, such as sputtering or thermal transfer from a donor sheet. The material to be deposited by sublimation can be vaporized from a sublimator "boat" often comprised of a tantalum material, e.g., as described in U.S. Pat. No. 6,237,529, or can be first coated onto a donor sheet and then sublimed in closer proximity to the substrate. Layers with a mixture of materials can utilize separate sublimator boats or the materials can be pre-mixed and coated from a single boat or donor sheet. Deposition can also be achieved using thermal dye transfer from a donor sheet (see U.S. Pat. Nos. 5,851,709 and 6,066,357) and inkjet method (see U.S. Pat. No. 6,066,357).

Optical Optimization

OLED devices of this invention can employ various well-known optical effects in order to enhance its properties if desired. This includes optimizing layer thicknesses to yield maximum light transmission, providing dielectric mirror structures, replacing reflective electrodes with light-absorbing electrodes, or providing colored, neutral density, or color conversion filters over the device. Filters, may be specifically provided over the cover or substrate or as part of the cover or substrate.

The invention has been described in detail with particular reference to certain preferred embodiments thereof, but it will be understood that variations and modifications can be effected within the spirit and scope of the invention.

Parts List

10 OLED light source
12 organic light emitting layer
14 cathode
16 anode
18 power source
20 substrate
21 tab portion of substrate
21' tab portion of substrate
22 encapsulating cover
24 first conductor
26 second conductor
28 step
34 lighting fixture
35 switch
36 aperture
36' aperture
38 second electrical contacts
39 clip
40 contacts
42 power converter
48 decorative channels
62 common edge
64 common center
103 anode
105 hole-injecting layer
107 hole-transporting layer
109 light-emitting layer
111 electron-transporting layer
113 cathode layer
250 voltage/current source
260 conductive wiring

What is claimed is:

1. A solid-state area illumination lighting apparatus, comprising:

a) a plurality of light sources, each light source having,
  i) a substrate;
  ii) an organic light emitting diode (OLED) layer deposited upon the substrate, the organic light emitting diode layer including first and second electrodes for providing electrical power to the OLED layer;
  iii) an encapsulating cover covering the OLED layer; and iv) first and second conductors located on the substrate and electrically connected to the first and second electrodes, and extending beyond the encapsulating cover for making electrical contact to the first and second electrodes by an external power source; and b) a lighting fixture for removably receiving and holding the plurality of light sources and having a plurality of first electrical contacts for making electrical connection to the first and second conductors of the light sources, and second electrical contacts for making electrical connection to an external power source.

2. The lighting apparatus claimed in claim 1, wherein the substrate defines one or more tab portions; the first and second conductors being located on the tab portion(s).

3. The lighting apparatus claimed in claim 2, wherein the substrate defines tabs that are located at opposite edges of the substrate.

4. The lighting apparatus claimed in claim 1, wherein the first and second conductors are located at one or more edges of the substrate.

5. The lighting apparatus claimed in claim 3, wherein the first and second conductors are located at opposite edges of the substrate.

6. The lighting apparatus claimed in claim 1, wherein the light sources emit light from one side of the substrate and the first and second conductors are located on an opposite side of the substrate.

7. The lighting apparatus claimed in claim 1, wherein the substrate is rigid and planar.

8. The lighting apparatus claimed in claim 1, wherein the substrate is flexible and the fixture includes a support to hold the substrate in a desired configuration.

9. The lighting apparatus claimed in claim 8, wherein the desired configuration is a plane.

10. The lighting apparatus claimed in claim 8, wherein the desired configuration is a cylinder.

11. The lighting apparatus claimed in claim 7, wherein the substrates are held in the fixture in one or more rows and wherein the substrates in a row are in a common plane.

12. The lighting apparatus claimed in claim 11, wherein the substrates in the common planes of two rows are oriented at an angle to each other.

13. The lighting apparatus claimed in claim 12, wherein the substrates are quadrilateral and an edge of each of the substrates in the two rows is located at the line of intersection of the planes.

14. The lighting apparatus claimed in claim 13, wherein each substrate defines a tab portion extending from the one edge, the first and second conductors being located on the tab portion, and the fixture defining a plurality of slots for receiving the tab portions.

15. The lighting apparatus claimed in claim 7, wherein the substrates are held in the fixture such that the planes intersect.

16. The lighting apparatus claimed in claim 15, wherein the substrates are quadrilateral and an edge of the substrates is located at the intersection.

17. The lighting apparatus claimed in claim 7, wherein the substrates are held in a common plane.

18. The lighting apparatus claimed in claim 17, wherein the substrates are arranged around a central point.

19. The lighting apparatus claimed in claim 18, wherein the substrates are trapezoidal and the sides of the trapezoids are in close arrangement.

20. The lighting apparatus claimed in claim 1, wherein the substrates are trapezoidal and are held in the fixture to define a section of a cone.

21. The lighting apparatus claimed in claim 1, wherein the fixture includes channels for receiving the sides of the substrates.

22. The lighting apparatus claimed in claim 1, wherein the substrates are symmetrically arranged in fan pattern.

23. The lighting apparatus claimed in claim 1, wherein the lighting fixture includes decorative channels for receiving edges of the light sources.

24. The lighting apparatus claimed in claim 1, wherein the light sources include a decorative feature selected from the group comprising a patterned substrate, a patterned cover, a colored substrate, and a colored cover.

25. A method of illuminating an area having a suspended ceiling, comprising the steps of:

a) providing a solid-state area illumination lighting apparatus, having a plurality of light sources, each light source having, a substrate; an organic light emitting diode (OLED) layer deposited upon the substrate, the organic light emitting diode layer including first and second electrodes for providing electrical power to the OLED layer; an encapsulating cover covering the OLED layer; and first and second conductors located on the substrate and electrically connected to the first and second electrodes, and extending beyond the encapsulating cover for making electrical contact to the first and second electrodes by an external power source; and a lighting fixture for removably receiving and holding the plurality of light sources and having a plurality of first electrical contacts for making electrical connection to the first and second conductors of the light sources, and second electrical contacts for making electrical connection to an external power source; and b) suspending the lighting apparatus in the suspended ceiling.

26. The lighting apparatus claimed in claim 25, wherein the substrates are inclined to function as a fan.

* * * * *